US006059011A

United States Patent [19]

Giolo

[11] Patent Number: 6,059,011

[45] Date of Patent: May 9, 2000

[54] LOW PRESSURE DIE-CASTING PLANT WITH IMPROVED PRODUCTION CAPACITY

[75] Inventor: Fabio Giolo, Bagnaria Arsa, Italy

[73] Assignee: IMR S.p.A., Romans D'Isonzo, Italy

[21] Appl. No.: 08/958,794

[22] Filed: Oct. 27, 1997

[51] Int. Cl.[7] ..... B22D 18/04; B22D 29/00

[52] U.S. Cl. ..... 164/306; 164/344

[58] Field of Search ..... 164/119, 306, 164/312, 323, 344, 404, 131

[56] References Cited

U.S. PATENT DOCUMENTS

| | | |
|---|---|---|
| 3,643,732 | 2/1972 | Carlsen . |
| 3,804,152 | 4/1974 | Cook et al. . |
| 4,425,958 | 1/1984 | Lüthy et al. . |
| 4,431,046 | 2/1984 | Phillips . |

FOREIGN PATENT DOCUMENTS

| | | | |
|---|---|---|---|
| 0 175 833 | 4/1986 | European Pat. Off. . | |
| 0 398 168 | 11/1990 | European Pat. Off. . | |
| 58-47558 | 3/1983 | Japan | 164/306 |
| 504 261 | 3/1971 | Switzerland . | |
| 2 015 398 | 9/1979 | United Kingdom . | |

*Primary Examiner*—Kuang Y. Lin
*Attorney, Agent, or Firm*—Guido Modiano; Albert Josif

[57] ABSTRACT

A low-pressure die-casting plant with improved production capacity, which comprises a first furnace and a second furnace with mutually independent operating pressures and metal levels. A station for unloading the cast parts and for performing graphitization of the dies is arranged between the furnaces. The furnaces can be selectively connected to respective dies which are associated with handling units which can be mutually detachably coupled for a synchronous translatory motion between a casting position and an unloading position and/or vice versa.

20 Claims, 5 Drawing Sheets

LOW PRESSURE DIE-CASTING PLANT WITH IMPROVED PRODUCTION CAPACITY

BACKGROUND OF THE INVENTION

The present invention relates to a low-pressure die-casting plant with improved production capacity.

Conventional low-pressure die-casting plants are usually constituted by a casting furnace in which a tube is immersed in order to dispense, by supplying pressure to the furnace, the liquid metal into a die which is connected to the metal drawing tube.

A handling unit is generally provided at the furnace and allows to perform the various operations for handling the die, to load the cores, unload the cast part, and perform the graphitization and cooling of the dies.

With these applications, if the production capacity is to be increased it is necessary to radically modify the furnaces, with considerable constructive complexities and very high power allocations.

Another typical problem of conventional plants is constituted by the fact that they are difficult to automate and furthermore do not allow to quickly modify the type of metal being cast.

SUMMARY OF THE INVENTION

The aim of the present invention is to solve the above problems, by providing a low-pressure die-casting plant which has a high production capacity despite having furnaces with relatively low power allocations.

Within the scope of this aim, a particular object of the invention is to provide a casting plant in which all downtimes are optimized, allowing to perform casting in one die whilst the cast part is unloaded from another die.

Another object of the present invention is to provide a casting plant which can be fully automated and is also extremely versatile and practical in use.

Another object of the present invention is to provide a die-casting plant which can be easily obtained starting from commonly commercially available elements and materials and is furthermore competitive from a merely economical point of view.

This aim, these objects, and others which will become apparent hereinafter are achieved by a low-pressure die-casting plant with improved production capacity, according to the invention, characterized in that it comprises a first furnace and a second furnace with mutually independent operating pressures and metal levels, a station for unloading the cast parts and for performing graphitization of the dies being arranged between said furnaces, said furnaces being selectively connectable to respective dies which are associated with handling units which can be mutually detachably coupled for a synchronous translatory motion between a casting position and an unloading position and/or vice versa.

BRIEF DESCRIPTION OF THE DRAWINGS

Further characteristics and advantages will become apparent from the description of a preferred but not exclusive embodiment of a low-pressure die-casting plant with improved production capacity, illustrated only by way of non-limitative example in the accompanying drawings, wherein.

DESCRIPTION OF THE PREFERRED EMBODIMENTS

Figure 1:
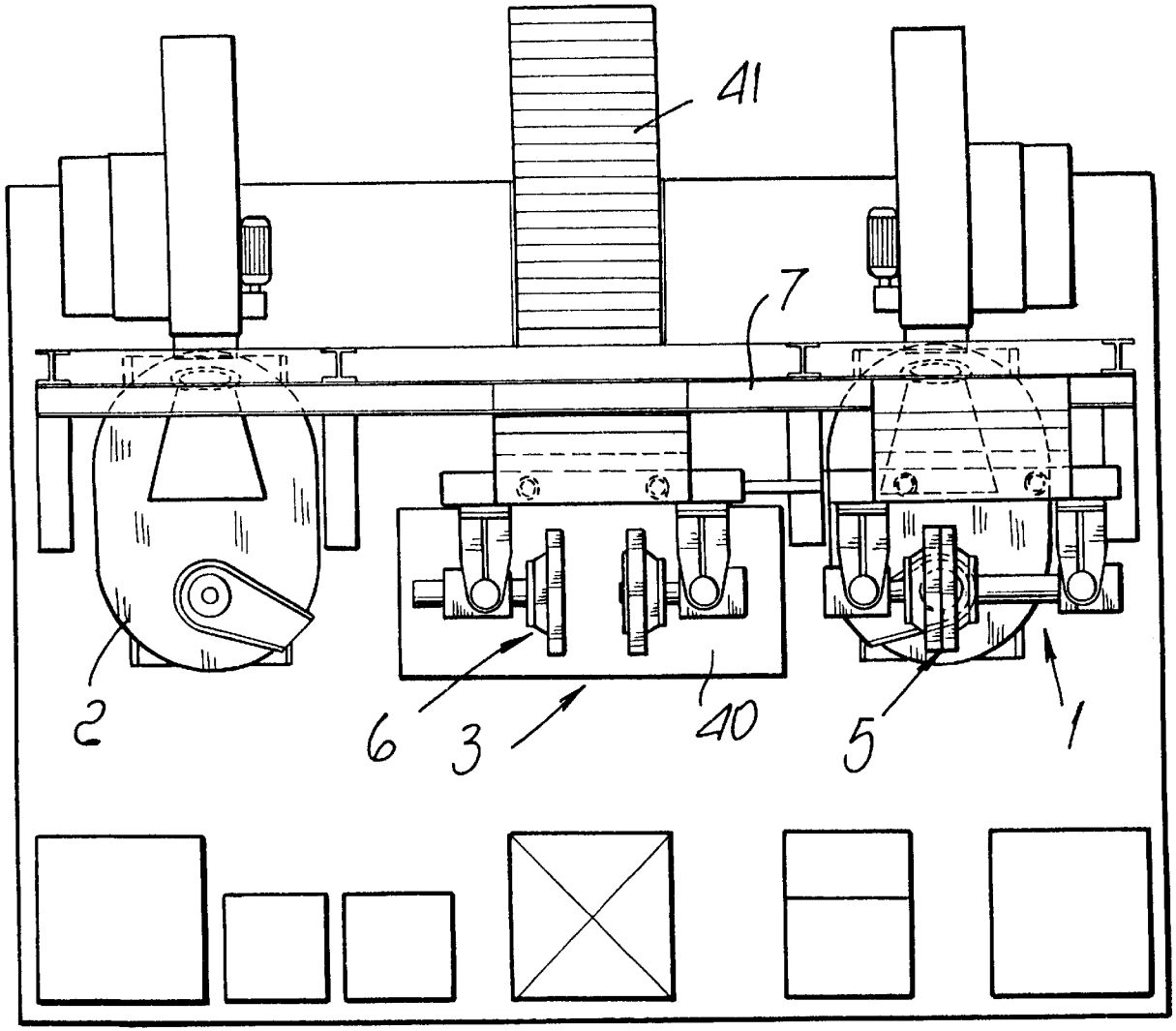
FIG. 1 is a schematic view of the die-casting plant according to the invention with the first furnace in the casting step.
Figure 2:
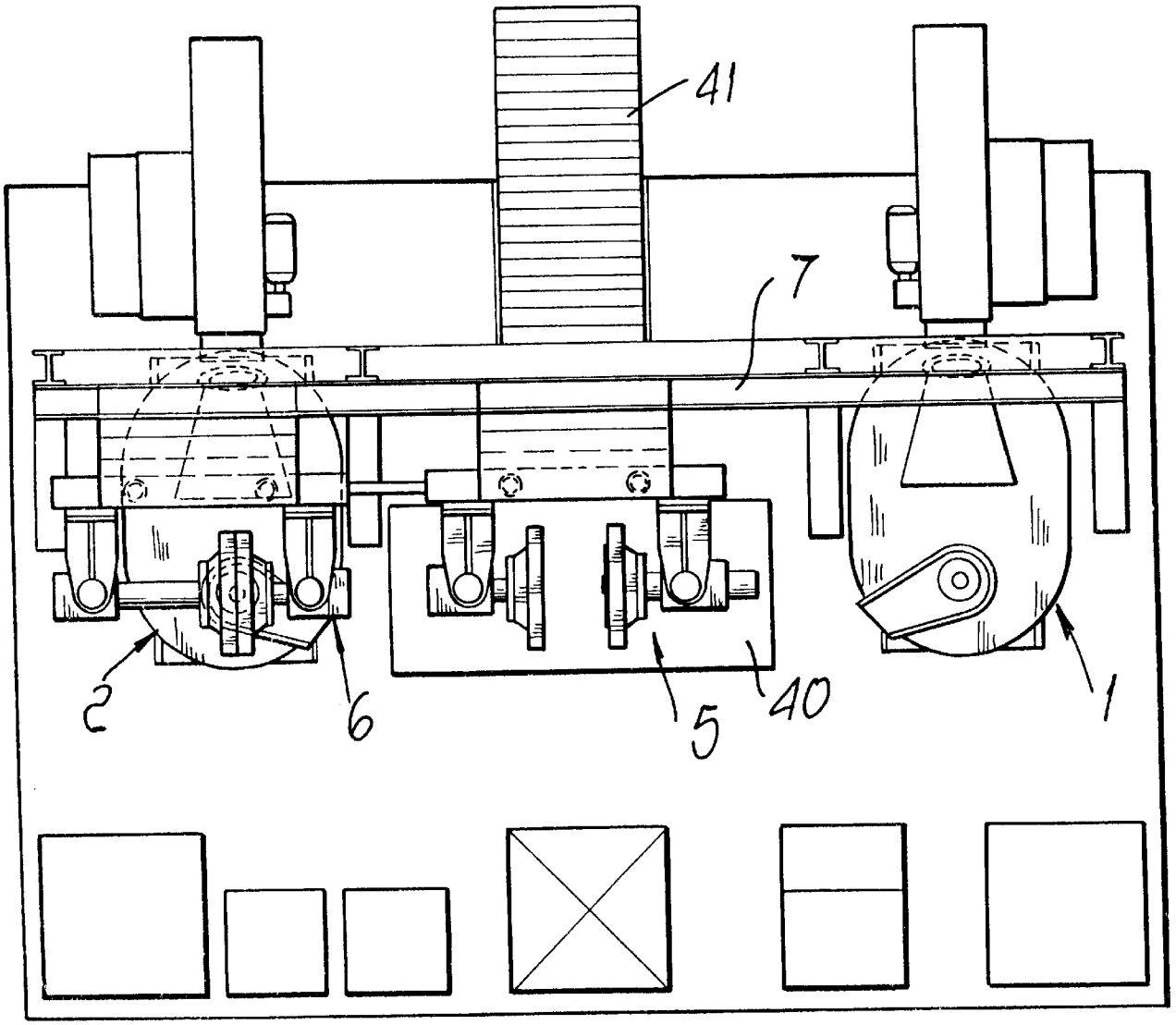
FIG. 2 is a view of the casting plant with the second furnace in the casting step.

With reference to the above figures, the low-pressure die-casting plant with improved production capacity, according to the invention, comprises a first furnace 1 and a second furnace 2 which can operate with different operating pressures and different metal levels, with the additional possibility of having two different alloys inside them.

The furnaces 1 and 2 are arranged to the side of an unloading station which is generally designated by the reference numeral 3 and performs, as will become apparent hereinafter, the unloading of the cast parts and the graphitization of the dies.

Two handling units 5 and 6, for casting dies, are provided supported at the frame of the modular plant. The handling units can be moved in translation by actuation units, shown schematically in FIGS. 1–2 and 7–9, along guides 7, between each of the first 1 and second 2 furnaces and the unloading station 3. The two furnaces 1, 2 are arranged advantageously side by side, with a space therebetween to accommodate the intermediary unloading station 3. The handling units 5, 6 can be operated in synchronism by being coupled to each other, for example by way of conventional mechanical means, or operated independently in uncoupled configuration.

Figure 3:
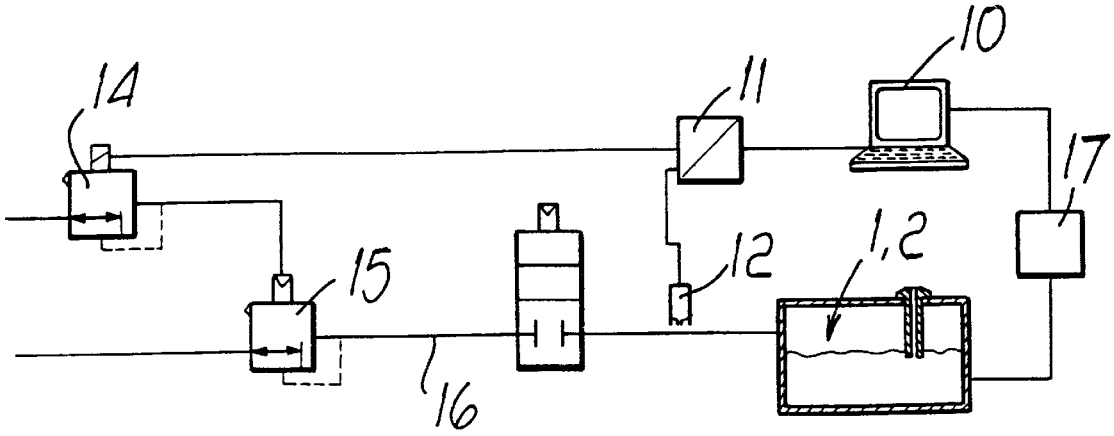
FIG. 3 is a schematic view of the automatic control of the pressure inside the furnaces.
Figure 4:
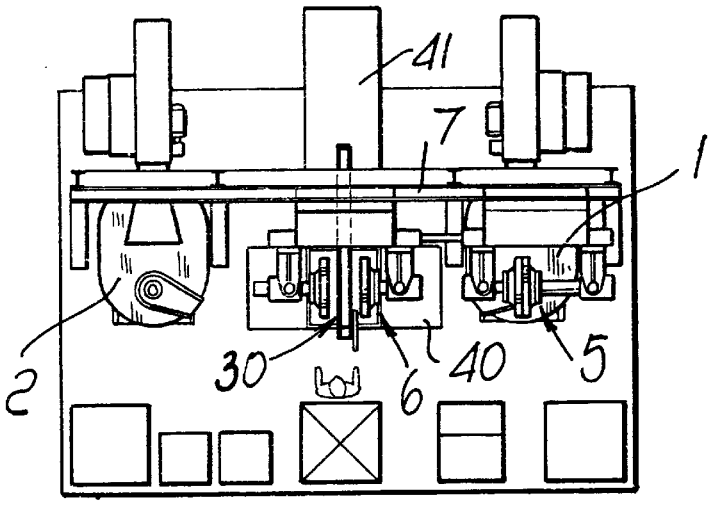
FIG. 4 is a schematic plan view of the step for picking up the cast part, with movement towards the operator.
Figure 5:
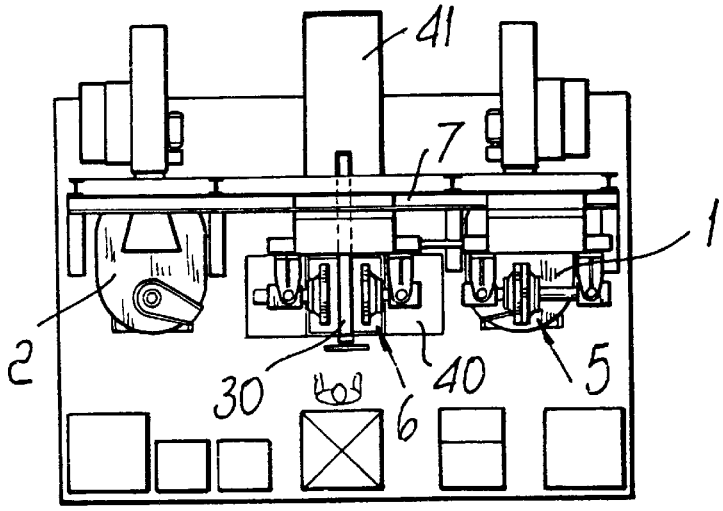
FIG. 5 is a view of the step for handling the cast part to show it to the operator, who performs instantaneous visual inspection.
Figure 6:
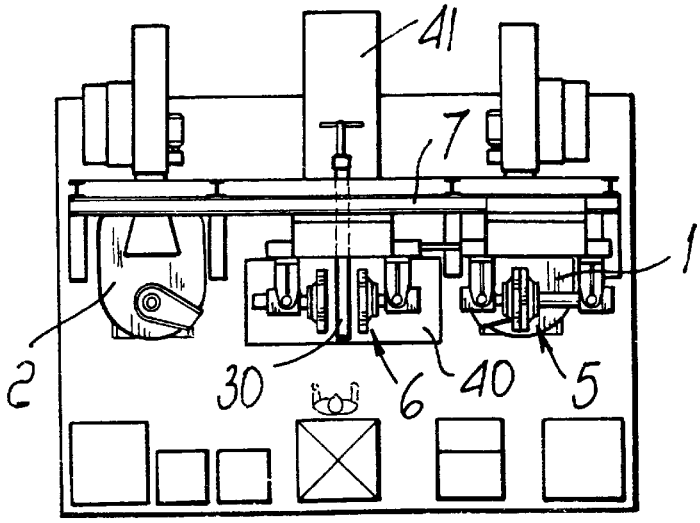
FIG. 6 is a plan view of the step for unloading the cast part.
Figure 7:
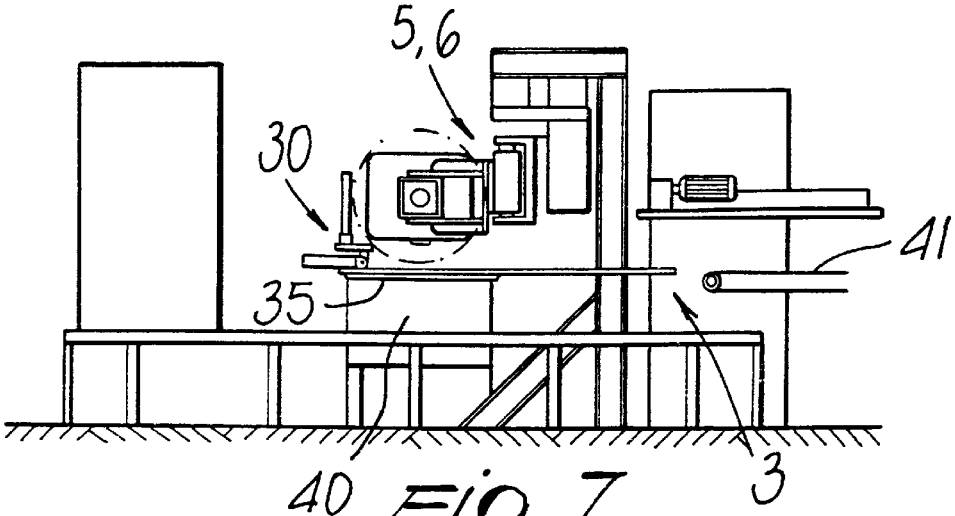
FIG. 7 is a plan view of the step for removing the cast part and rotating it towards the operator to allow him to view the part.

In greater detail, the furnaces 1 and 2, which have standard dimensions and a consequent relatively limited power allocation, are controlled, as shown by the diagram of FIG. 3, by a computerized central unit 10, which drives a converter 11 to which a pressure transducer 12 is connected which detects the pressure inside each furnace 1 or 2.

The converter drives a proportional valve 14, which in turn controls a large-capacity pressure valve 15 which is interposed along the line 16 which controls the pressure inside the furnace.

Load cells 17 are also provided, which have the purpose of detecting the presence of material so as to adjust the curve of the pressures which can be obtained.

When performing the castings, it is necessary to be able to feed the material according to the various operating steps by performing controlled pressurization of the furnace.

The computerized control of the plant allows to provide any kind of pressure curve, so that it is possible to always obtain an optimized casting step throughout the execution of the process.

The load cells for the level of the metal in the furnace also allow to automatically vary the pressure in order to always reach the threshold set in the pressurization process, regardless of the variation of the level of the metal in the furnace; the same result can be achieved by replacing the load cells with laser detectors which use a laser beam which reflects off the surface, or with graphite floaters connected to an instrument which produces an analog output.

As shown in FIGS. 4 to 9, the handling units 5 and 6 have the purpose of alternately performing casting in the dies, at one of the furnaces, whilst the other handling unit performs unloading at the unloading station.

In particular, there is provided a removal unit, designated by the reference numeral 30, which removes the cast part and, after moving it forwards (FIG. 4), turns it (FIG. 5) so as to show it to the operator, who can immediately detect any defects.

Correspondingly, a tray 35 is arranged above the graphitization tanks 40 so as to retain any part which might slip down.

Figure 8:
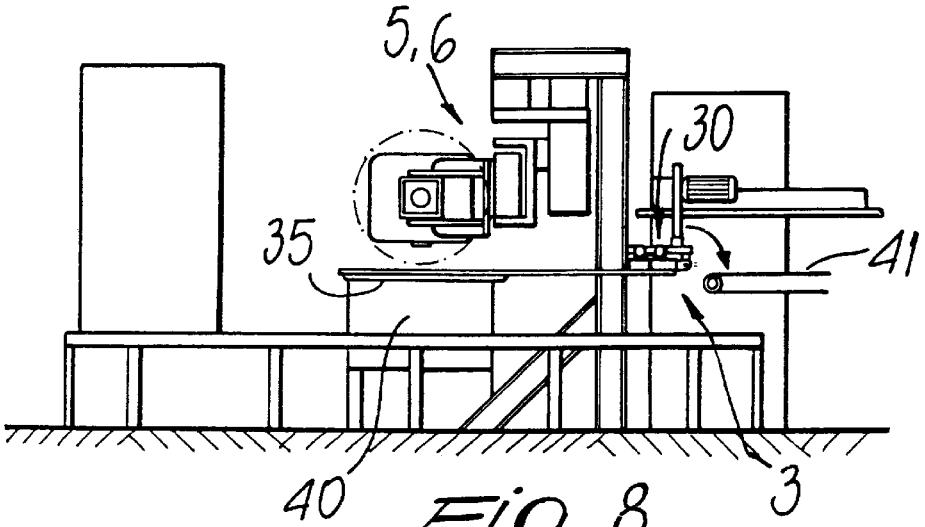
FIG. 8 is a view of the movement of the handling unit towards the transfer belt.
Figure 9:
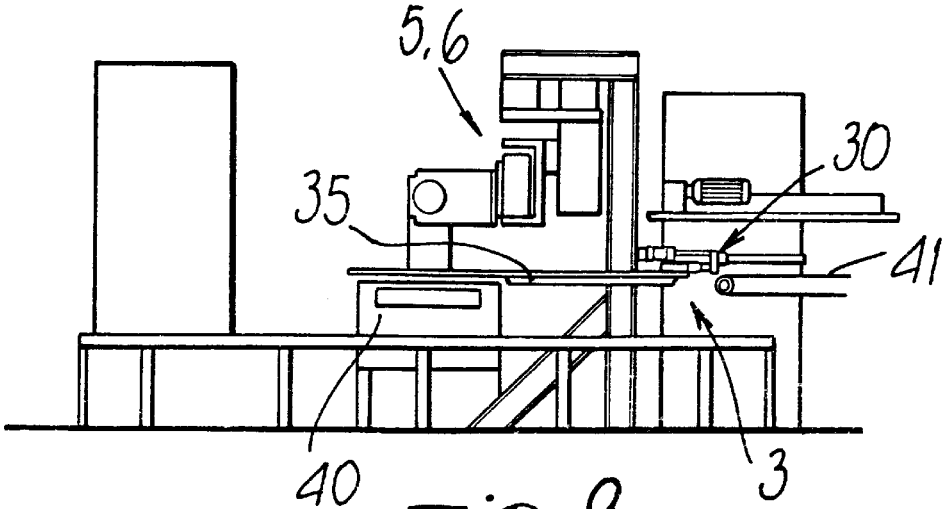
FIG. 9 is a view of the step for unloading the part.

After the part has been inspected by the operator, the removal unit retracts and, after overturning, as shown in FIGS. 8 and 9, unloads the part onto an unloading belt 41.

Then the handling unit introduces the dies in the graphitization tanks 40 to treat the dies and cool them.

Figure 10:
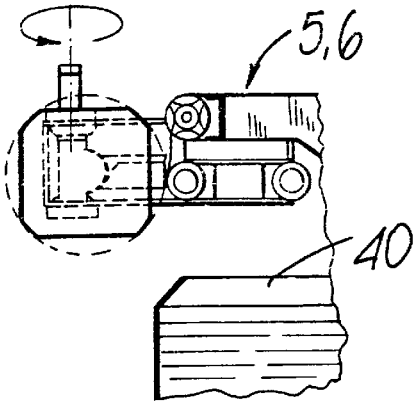
FIGS. 10, 11, and 12 are sequential views of the step for the spray graphitization of the die.
Figure 11:
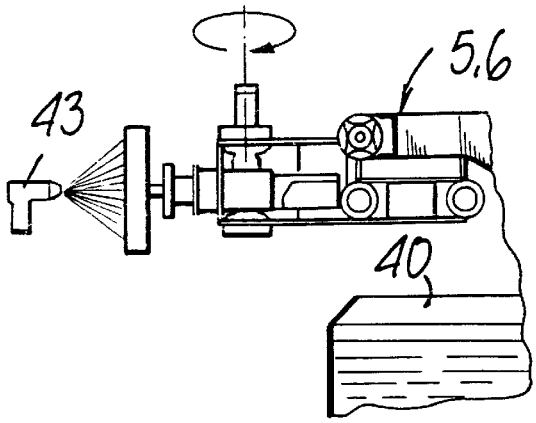
Figure 12:
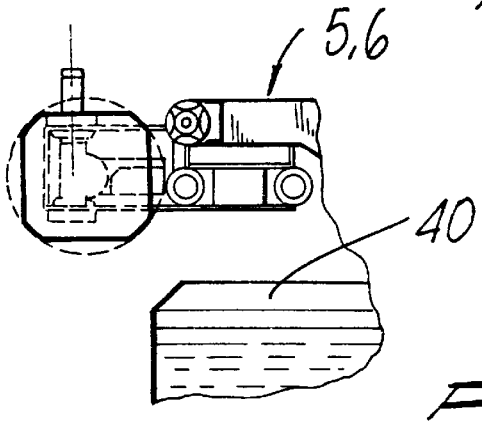

Optionally, the graphitization step, as shown in FIGS. 10 to 12, can be performed by spray-coating with a spray nozzle 43 which is arranged frontally with respect to the apparatus, so as to treat the dies which are arranged in front of said nozzle.

It should be added to the above that during the normal production steps there are provided means for vertically lifting the furnaces to apply them to the die, or optionally there are provided means for the descent of the handling unit, so as to couple the casting tube to the die.

With the above-described arrangement, therefore, whilst one of the dies is in the casting step, the other die is in the step for unloading the part and for preparing the dies for subsequent casting and for core insertion.

Once the various operations have been completed, the cycle resumes with a translatory motion of the handling unit, which places the previously unloaded die at the furnace in order to fill it, whilst the other die in which casting had been performed is arranged at the unloading unit.

Independent operation of one or both of the two handling units 5, 6 can be accomplished at any time, when desired, for example when one of the two furnaces 1, 2 as stopped for maintenance.

From the above description it is thus evident that the invention achieves the intended aim and objects, and in particular the fact is stressed that an automatic casting plant is provided which is capable of considerably simplifying all the casting operations, achieving a very high hourly production rate with a reduced power allocation and with the possibility of having a single operator who controls both furnaces.

The invention thus conceived is susceptible of numerous modifications and variations, all of which are within the scope of the inventive concept.

All the details may furthermore be replaced with other technically equivalent elements.

In practice, the materials employed, as well as the contingent shapes and dimensions, may be any according to requirements.

What is claimed is:

1. A low-pressure die-casting modular plant, comprising: casting dies;

a first furnace operatable at various operating pressures and metal levels;

a second furnace, operatable independently from the first furnace at various operating pressures and metal levels which are selectable to be different from the operating pressures and metal levels of the first furnace, said second furnace being located next to, and spaced from the first furnace;

an intermediate unloading station located between said first and second furnaces for unloading cast parts casted at any of said first and second furnaces and for performing graphitization of the dies;

a least one removal unit for removing the cast parts from the casting dies for visual inspection thereof at said unloading station; and at least two handling units for handling casting dies, said handling units being movable in translation between each of said first and second furnaces and said unloading station and being operatable both separately, and, upon coupling to each other, in synchronism.

2. The casting plant of claim 1, further comprising:

a pressures transducer means for detecting the pressure inside each of said furnaces;

a high-capacity pressure valve which is interposed along a line for feeding pressure into each one of said furnaces;

a proportional valve means for controlling said high-capacity pressure valve;

a conversion device for driving said proportional valve means, said conversion device being connected to said pressure transducer means; and a computerized central unit for driving said conversion device.

3. The casting plant of claim 2, comprising load cells for detecting a casting material level in each of said first and second furnaces, said load cells being connected to said computerized central unit for pressure adjustments during casting to compensate for variations of the casting material level in said first and second furnaces.

4. The casting plant of claim 1, comprising an unloading belt provided at said unloading station, said at least one removal unit being movable both in translation and in rotation to move casted parts towards an operator placed in front of the unloading station, rotate said casted parts so as to be visually controlled by the operator, and to place the casted parts on said unloading belt.

5. The casting plant of claim 1, further comprising graphitization tanks and a tray, said tray being arrangeable above said graphitization tanks during the removal of the cast parts.

6. The casting plant of claim 5, wherein said handling units are operatable to place said dies in said graphitization tanks.

7. The casting plant of claim 1, further comprising spray nozzles for spray graphitization of said dies.

8. The casting plant of claim 1, further comprising casting tubes, and lifting means for vertically lifting said furnaces to connect the casting tubes to the dies.

9. The casting plant of claim 8, further comprising actuation means for lowering said handling units to couple the casting tube to the die.

10. The casting plant of claim 1, wherein said handling units are operated uncoupled in order for servicing a single furnace selected from said first and second furnaces.

11. A low-pressure die-casting modular plant, comprising:

casting dies;

a first furnace operatable at various operating pressures and metal levels;

a second furnace, operatable independently from the first furnace at various operating pressures and metal levels, selectable so as to be different from the operating pressures and metal levels of the first furnace;

an intermediate unloading station for unloading cast parts casted at any of said first and second furnaces and for performing graphitization of the dies;

at least two handling units for handling casting dies, said handling units being coupleable to each other and operatable both separately in uncoupled configuration, and, upon coupling to each other, jointly in synchronism;

an inspection station at which quality of the unloaded cast parts is evaluated by a plant operator; and a transport station for transporting the cast parts following quality evaluation;

wherein said intermediary unloading station is arranged between said first and second furnace which are located in line and spaced from each other, with said inspection station and said transport station being arranged in front, and, at the rear of said unloading station, respectively, and wherein said handling units are movable in translation between each of said first and second furnaces and said unloading station.

12. The casting plant of claim 11, further comprising:

a pressure transducer means for detecting the pressure inside each of said furnaces;

a high-capacity pressure valve which is interposed along a line for feeding pressure into each one of said furnaces;

a proportional valve means for controlling said high-capacity pressure valve;

a conversion device for driving said proportional valve means, said conversion device being connected to said pressure transducer means; and a computerized central unit for driving said conversion device.

13. The casting plant of claim 12, comprising load cells for detecting a casting material level in each of said first and second furnaces, said road cells being connected to said computerized central unit for pressure adjustments during casting to compensate for variations of the casting material level in said first and second furnaces.

14. The casting plant of claim 11, wherein said transport station comprises an unloading belt, said at least one removal unit being movable both in translation and in rotation to move casted parts towards an operator placed at said inspection station, in front of the unloading station, rotate the casted parts so as to be visually controlled by the operator, and to place the casted parts on said unloading belt.

15. The casting plant of claim 11, further comprising graphitization tanks and a tray, said tray being arrangeable above said graphitization tanks during the removal of the cast parts.

16. The casting plant of claim 15, wherein said handling units are operatable to place said dies in said graphitization tanks.

17. The casting plant of claim 11, further comprising spray nozzles for spray graphitization of said dies.

18. A low-pressure die-casting modular plant, comprising:

casting dies;

a first furnace operatable at various operating pressures and metal levels;

a second furnace, operatable independently from the first furnace at various operating pressures and metal levels which are selectable to be different from the operating pressures and metal levels of the first furnace, said second furnace being located next to, and spaced from the first furnace;

an intermediate unloading station located between said first and second furnaces for unloading cast parts casted at any of said first and second furnaces and for performing graphitization of the dies; and at least two handling units for handling casting dies movable in translation between each of said first and second furnaces and said unloading station, said handling units being operatable both separately, and in synchronism, by being coupled to each other for joint operation; and an inspection station, located in front of said unloading station, for assessing quality of the unloaded cast parts through evaluation thereof carried out by a plant operator.

19. The casting plant of claim 18, further comprising an unloading belt, located at the rear of said unloading station, and at least one removal unit operating at said unloading station, said removal unit being movable both in translation and in rotation to move casted parts towards an operator placed at said inspection station, in front of the unloading station, rotate the casted parts so as to be visually controlled by the operator, and place the casted parts on said unloading belt.

20. The casting plant of claim 18, further comprising:

a pressure transducer means for detecting the pressure inside each of said furnaces;

a high-capacity pressure valve which is interposed along a line for feeding pressure into each one of said furnaces;

a proportional valve means for controlling said high-capacity pressure valve;

a conversion device for driving said proportional valve means, said conversion device being connected to said pressure transducer means; and a computerized central unit for driving said conversion device.

* * * * *